US011274838B2

(12) United States Patent
Hirata et al.

(10) Patent No.: US 11,274,838 B2
(45) Date of Patent: Mar. 15, 2022

(54) AIR-CONDITIONER OUTDOOR HEAT EXCHANGER AND AIR-CONDITIONER INCLUDING THE SAME

(71) Applicant: HITACHI-JOHNSON CONTROLS AIR CONDITIONING, INC., Tokyo (JP)

(72) Inventors: Takumi Hirata, Tokyo (JP); Ryoichi Takafuji, Tokyo (JP); Mamoru Houfuku, Tokyo (JP); Naoki Yamamoto, Tokyo (JP); Ryou Karino, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 163 days.

(21) Appl. No.: 16/674,116

(22) Filed: Nov. 5, 2019

(65) Prior Publication Data

US 2020/0072478 A1 Mar. 5, 2020

Related U.S. Application Data

(63) Continuation of application No. PCT/JP2018/021478, filed on Jun. 5, 2018.

(30) Foreign Application Priority Data

Jul. 5, 2017 (JP) ..... JP2017-131586

(51) Int. Cl.
*F25B 39/02* (2006.01)
*F24F 1/18* (2011.01)
(Continued)

(52) U.S. Cl.
CPC ..... *F24F 1/18* (2013.01); *F25B 39/00* (2013.01); *F28D 1/053* (2013.01); *F28F 9/02* (2013.01)

(58) Field of Classification Search
CPC ... F24F 1/18; F25B 39/00; F28D 1/053; F28F 9/02
(Continued)

(56) References Cited

U.S. PATENT DOCUMENTS 5,203,407 A 4/1993 Nagasaka
5,529,116 A 6/1996 Sasaki et al.
(Continued)

FOREIGN PATENT DOCUMENTS

CN 103620336 A 3/2014
EP 414433 A2 2/1991
(Continued)

OTHER PUBLICATIONS

The attached pdf file is translation of foreign reference JP-2013015289-A (Year: 2013).*
(Continued)

*Primary Examiner* — Henry T Crenshaw
*Assistant Examiner* — Kamran Tavakoldavani
(74) *Attorney, Agent, or Firm* — Mattingly & Malur, PC

(57) ABSTRACT

An air-conditioner outdoor heat exchanger has a fin, multiple heat transfer pipes thermally connected to the fin, having a flat sectional shape, and configured such that refrigerant flows through header pipes connected to inlet and outlet sides of the heat transfer pipes. The refrigerant flows through the heat transfer pipes in parallel, and when the refrigerant returns from the outlet-side header pipe to the inlet-side header pipe through the heat transfer pipes, the refrigerant returns to the inlet-side header pipe through one of the heat transfer pipes adjacent to another one of the heat transfer pipes through which the refrigerant has flowed when flowing from the inlet-side header pipe to the outlet-side header pipe. At least two systems of refrigerant paths are formed, and the refrigerant flows back and forth in each
(Continued)

system between the inlet-side header pipe and the outlet-side header pipe.

6 Claims, 9 Drawing Sheets

(51) Int. Cl.
*F25B 39/00* (2006.01)
*F28D 1/053* (2006.01)
*F28F 9/02* (2006.01)

(58) Field of Classification Search
USPC ..... 62/525
See application file for complete search history.

(56) References Cited

U.S. PATENT DOCUMENTS

| | | | | |
|---|---|---|---|---|
| 5,743,328 | A | 4/1998 | Sasaki et al. | |
| 6,021,846 | A | 2/2000 | Sasaki et al. | |
| 2015/0226489 | A1 | 8/2015 | Higashiiue | |
| 2016/0327343 | A1* | 11/2016 | Hwang | F28F 9/0204 |
| 2017/0241684 | A1* | 8/2017 | Ito | F28F 9/026 |
| 2018/0100659 | A1* | 4/2018 | Yoshimura | F28F 1/128 |

FOREIGN PATENT DOCUMENTS

| | | | | | |
|---|---|---|---|---|---|
| EP | 643278 | A2 | | 3/1995 | |
| JP | 03-84395 | A | | 4/1991 | |
| JP | 3-128262 | U | | 12/1991 | |
| JP | 04-174297 | A | | 6/1992 | |
| JP | 2005-127529 | A | | 5/2005 | |
| JP | 2012-163313 | A | | 8/2012 | |
| JP | 5073849 | B1 | | 11/2012 | |
| JP | 2013-015289 | A | | 1/2013 | |
| JP | 2013015289 | A | * | 1/2013 | F28D 1/05391 |
| JP | 2014-74563 | A | | 4/2014 | |
| JP | 2015-78830 | A | | 4/2015 | |
| WO | 2013/005729 | A1 | | 1/2013 | |
| WO | 2014/054533 | A1 | | 4/2014 | |
| WO | 2017/068723 | A1 | | 4/2017 | |

OTHER PUBLICATIONS

International Search Report and Written Opinion of PCT/JP2018/021478 dated Aug. 28, 2018.
Japanese Office Action received in corresponding Japanese Application No. 2019-527588 dated Jan. 19, 2021.

* cited by examiner

AIR-CONDITIONER OUTDOOR HEAT EXCHANGER AND AIR-CONDITIONER INCLUDING THE SAME

CROSS-REFERENCE TO RELATED APPLICATION

The present application is a continuation application of International Application No. PCT/JP2018/021478, filed Jun. 5, 2018, which claims priority to Japanese Patent Application No. 2017-131586, filed Jul. 5, 2017. The contents of these applications are incorporated herein by reference in their entirety.

BACKGROUND

1. Technical Field

The present disclosure relates to an air-conditioner outdoor heat exchanger and an air-conditioner including the outdoor heat exchanger.

2. Related Art

A high efficiency of heat exchange has been demanded for a heat exchanger forming an air-conditioner. Thus, a technique described in JP-A-2015-78830 has been known as a technique for enhancing the efficiency of heat exchange. JP-A-2015-78830 describes that an outdoor heat exchanger is configured such that a windward main heat exchange region includes a windward main line portion, a leeward main heat exchange region includes a leeward main line portion, a windward auxiliary heat exchange region includes a windward auxiliary line portion, and a leeward auxiliary heat exchange region includes a leeward auxiliary line portion. Moreover, it is described that each of the main line portions and the auxiliary line portions includes multiple flat pipes. Further, it is described that in a heat exchanger functioning as an evaporator, refrigerant flows in the order of the windward auxiliary line portion, the leeward auxiliary line portion, the leeward main line portion, and the windward main line portion. On the other hand, it is described that in a heat exchanger functioning as a condenser, refrigerant flows in the order of the windward main line portion, the leeward main line portion, the leeward auxiliary line portion, and the windward auxiliary line portion.

SUMMARY

An air-conditioner outdoor heat exchanger according to an embodiment of the present disclosure includes a fin, multiple heat transfer pipes thermally connected to the fin, having a flat sectional shape, and configured such that refrigerant flows in the multiple heat transfer pipes, and header pipes each connected to an inlet side and an outlet side of the multiple heat transfer pipes, wherein the refrigerant flows through the multiple heat transfer pipes between the inlet-side header pipe and the outlet-side header pipe so that heat exchange in the outdoor heat exchanger is performed, each heat transfer pipe has multiple flow paths, the multiple heat transfer pipes are each connected to the header pipes on the inlet and outlet sides such that when the refrigerant flows from the inlet-side header pipe to the outlet-side header pipe through the multiple heat transfer pipes, the refrigerant flows through the multiple heat transfer pipes in parallel toward the outlet-side header pipe, when the refrigerant returns from the outlet-side header pipe to the inlet-side header pipe through the multiple heat transfer pipes, the refrigerant returns to the inlet-side header pipe through one of the heat transfer pipes adjacent to another one of the heat transfer pipes through which the refrigerant has flowed when flowing from the inlet-side header pipe to the outlet-side header pipe, in the inlet-side header pipe, the outlet-side header pipe, and the multiple heat transfer pipes, at least two systems of refrigerant paths are formed, the refrigerant flows back and forth in each system between the inlet-side header pipe and the outlet-side header pipe, and when the refrigerant returns to the outlet-side header pipe at the end, the two systems of the flow paths of the refrigerant are adjacent to each other.

DETAILED DESCRIPTION

Figure 1:
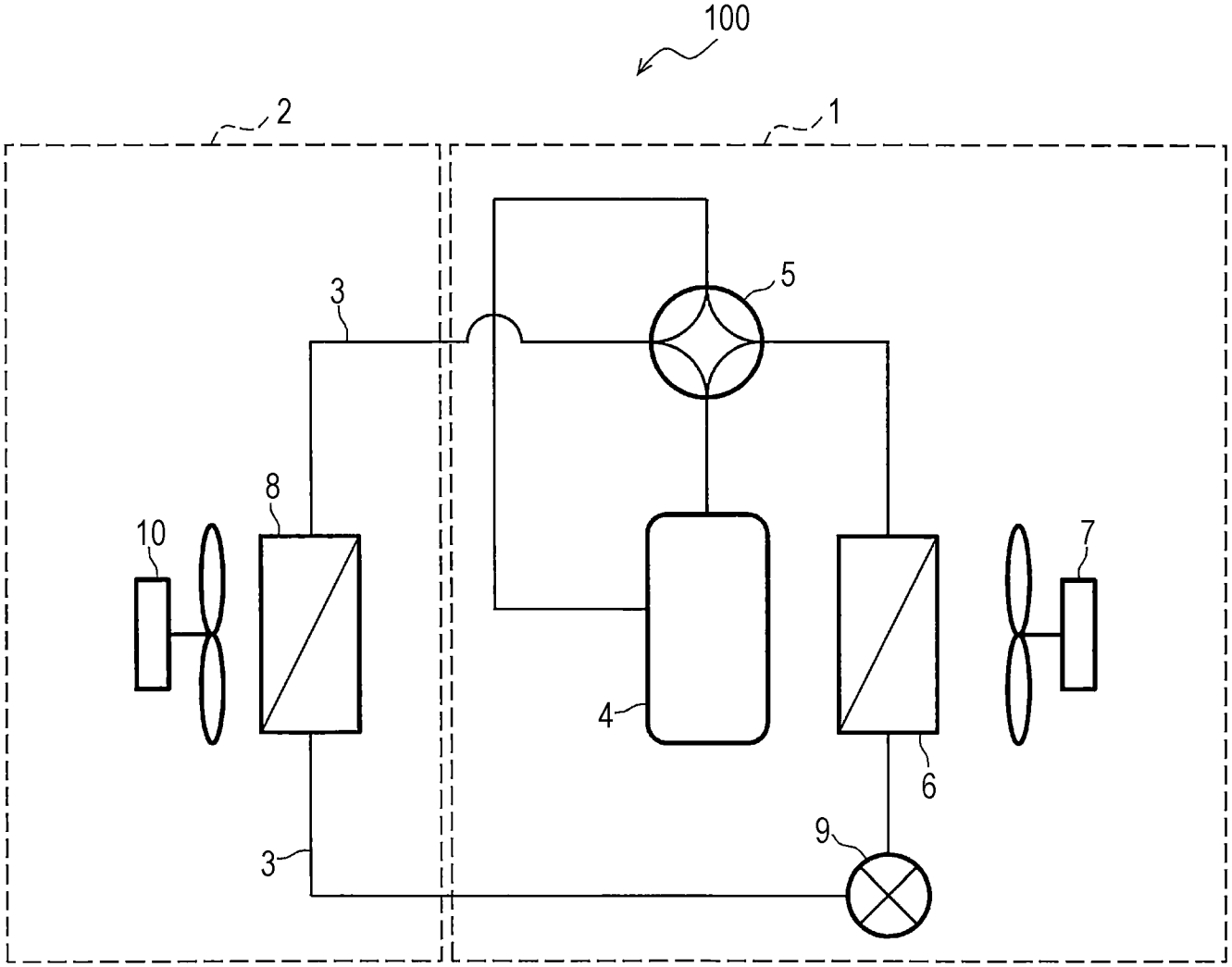
FIG. 1 is a system diagram of a refrigerant circuit of an air-conditioner according to a first embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the air-conditioner outdoor heat exchanger described in JP-A-2015-78830, a refrigerant flow path is complicated, and external pipes are increased. This leads to a higher cost of the heat exchanger. With the increased external pipes, brazed portions are increased, and refrigerant leakage is easily caused.

The present invention has been made in view of this situation, and a problem to be solved by the present invention is to provide an air-conditioner outdoor heat exchanger configured so that heat exchange performance can be maintained at low cost and durability can be enhanced and an air-conditioner including the outdoor heat exchanger.

The inventor(s) of the present invention has conducted intensive study to solve the above-described problem. As a result, the inventor(s) has found as follows, and has brought the present invention to completion. That is, an air-conditioner outdoor heat exchanger according to an embodiment of the present disclosure includes a fin, multiple heat transfer pipes thermally connected to the fin, having a flat sectional shape, and configured such that refrigerant flows in the multiple heat transfer pipes, and header pipes each connected to an inlet side and an outlet side of the multiple heat transfer pipes, wherein the refrigerant flows through the multiple heat transfer pipes between the inlet-side header pipe and the outlet-side header pipe so that heat exchange in the outdoor heat exchanger is performed, each heat transfer pipe has multiple flow paths, the multiple heat transfer pipes are each connected to the header pipes on the inlet and outlet sides such that when the refrigerant flows from the inlet-side header pipe to the outlet-side header pipe through the multiple heat transfer pipes, the refrigerant flows through the multiple heat transfer pipes in parallel toward the outlet-side header pipe, when the refrigerant returns from the outlet-side header pipe to the inlet-side header pipe through the multiple heat transfer pipes, the refrigerant returns to the inlet-side header pipe through one of the heat transfer pipes adjacent to another one of the heat transfer pipes through which the refrigerant has flowed when flowing from the inlet-side header pipe to the outlet-side header pipe, in the inlet-side header pipe, the outlet-side header pipe, and the multiple heat transfer pipes, at least two systems of refrigerant paths are formed, the refrigerant flows back and forth in each system between the inlet-side header pipe and the outlet-side header pipe, and when the refrigerant returns to the outlet-side header pipe at the end, the two systems of the flow paths of the refrigerant are adjacent to each other. Other solutions will be described later in description of embodiments.

According to the present disclosure, the air-conditioner outdoor heat exchanger configured so that the heat exchange performance can be maintained at low cost and the durability can be enhanced and the air-conditioner including the outdoor heat exchanger can be provided.

Hereinafter, embodiments will be described in detail with reference to the drawings. Note that the same reference numerals are used to represent common elements in each figure, and overlapping description will be omitted.

First Embodiment

FIG. 1 is a system diagram of a refrigerant circuit of an air-conditioner 100 according to a first embodiment. As illustrated in FIG. 1, the air-conditioner 100 includes an outdoor unit 1 placed outside a room (in a non-air-conditioning space) on a heat source side, and an indoor unit 2 placed inside the room (in an air-conditioning space) on a utilization side. These devices are connected to each other through a refrigerant pipe 3.

Regarding basic operation of the air-conditioner 100, heating operation and cooling operation will be separately described. In the case of the heating operation, gaseous refrigerant compressed by a compressor 4 flows into an indoor heat exchanger 8 through a four-way valve 5. Then, the flowing refrigerant exchanges heat with indoor air in an air flow generated by an indoor air blower 10, and accordingly, is condensed from a gaseous state to a liquid state. The refrigerant having turned into the liquid state flows into an outdoor heat exchanger 6 through an expansion valve 9. The flowing refrigerant absorbs heat of outdoor air by an air flow generated by an outdoor air blower 7, thereby performing heat exchange. Accordingly, the refrigerant is evaporated from the liquid state to the gaseous state, and then, flows into the compressor 4.

In the case of the cooling operation, the four-way valve 5 is switched to reverse a refrigerant flow direction from that of the heating operation. Gaseous refrigerant compressed by the compressor 4 flows into the outdoor heat exchanger 6 through the four-way valve 5. The flowing refrigerant releases heat to outdoor air in the air flow generated by the outdoor air blower 7, thereby performing heat exchange. Accordingly, the refrigerant is condensed from the gaseous state to the liquid state. The refrigerant having turned into the liquid state flows into the indoor heat exchanger 8 through the expansion valve 9. The flowing refrigerant absorbs heat from indoor air in the air flow generated by the indoor air blower 10, and accordingly, is evaporated into the gaseous state. Then, the refrigerant flows into the compressor 4.

Figure 2:
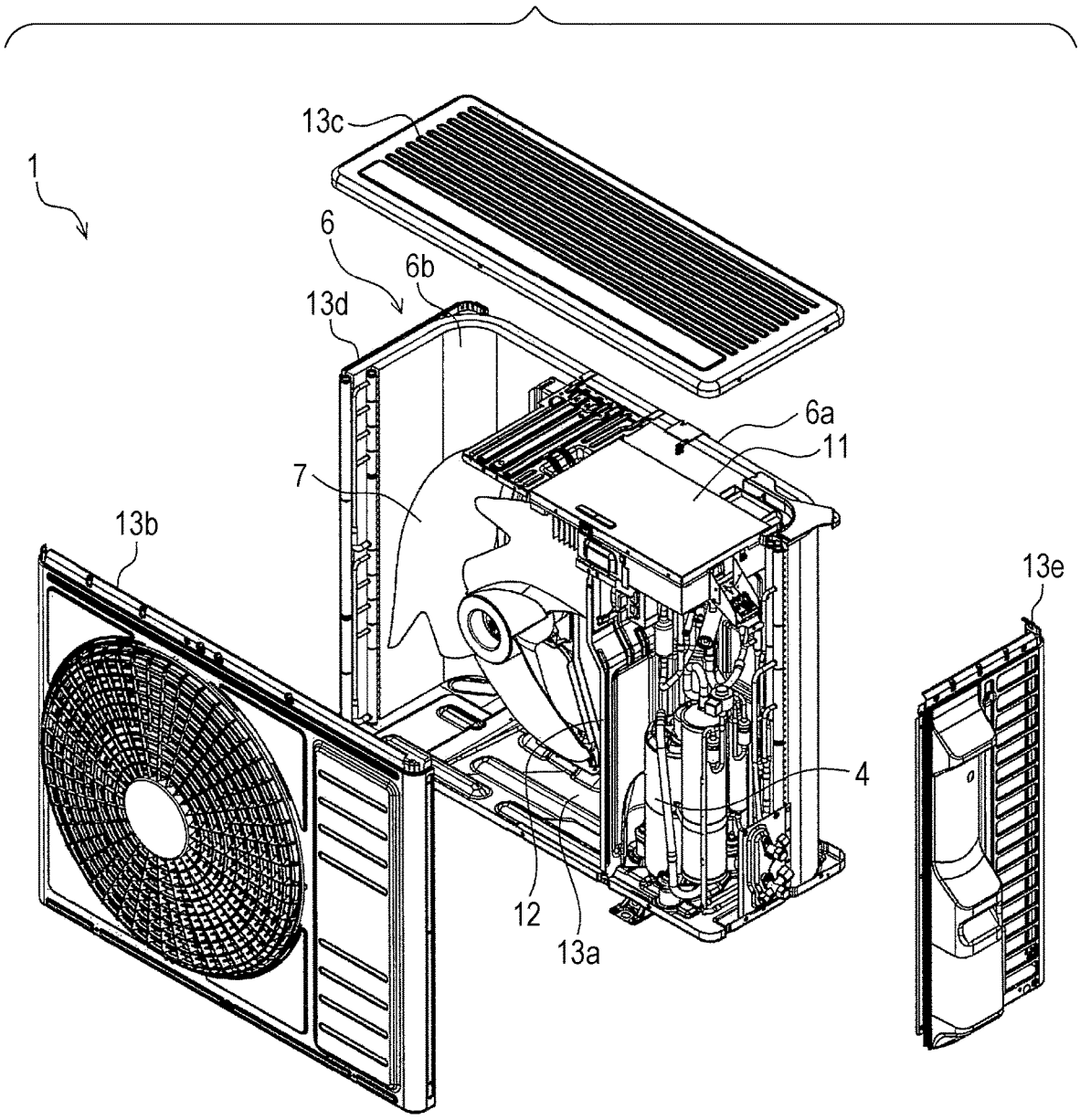
FIG. 2 is an exploded perspective view of an outer appearance of an outdoor unit of the air-conditioner according to the first embodiment.

FIG. 2 is an exploded perspective view of an outer appearance of the outdoor unit 1 of the air-conditioner 100 according to the first embodiment. As illustrated in FIG. 2, the outdoor unit 1 includes, as a housing thereof, a base 13*a*, a front plate 13*b*, a top plate 13*c*, a left plate 13*d*, and a right plate 13*e*. These components are formed from coated steel plates, for example.

In the outdoor unit 1, the outdoor heat exchanger 6 and a partition plate 12 configured to divide the inside of the outdoor unit 1 into an air blowing chamber and a machine chamber are placed. Of these components, the outdoor heat exchanger 6 includes two heat exchangers, i.e., an outdoor heat exchanger 6*a* arranged on a windward side along an air flow direction and an outdoor heat exchanger 6*b* arranged on a leeward side along the air flow direction.

An electric box 11 is arranged above the partition plate 12, and is supported by the partition plate 12. In the air blowing chamber, the outdoor heat exchanger 6, the outdoor air blower 7, and a motor support member (not shown) are arranged. In the machine chamber, the compressor 4 (see FIG. 1), the four-way valve 5 (see FIG. 1), and the expansion valve 9 (see FIG. 1) are arranged.

Outdoor air is sucked from a back side of the outdoor unit 1 by the outdoor air blower 7, and after having passed through the outdoor heat exchanger 6, is blown from the front plate 13*b* of the outdoor unit 1. The outdoor heat exchanger 6 is arranged curved from the inside of the left plate 13*d* to a back surface of the outdoor unit 1 to cover the inside of the left plate 13*d* and the back side of the outdoor unit 1.

Figure 3:
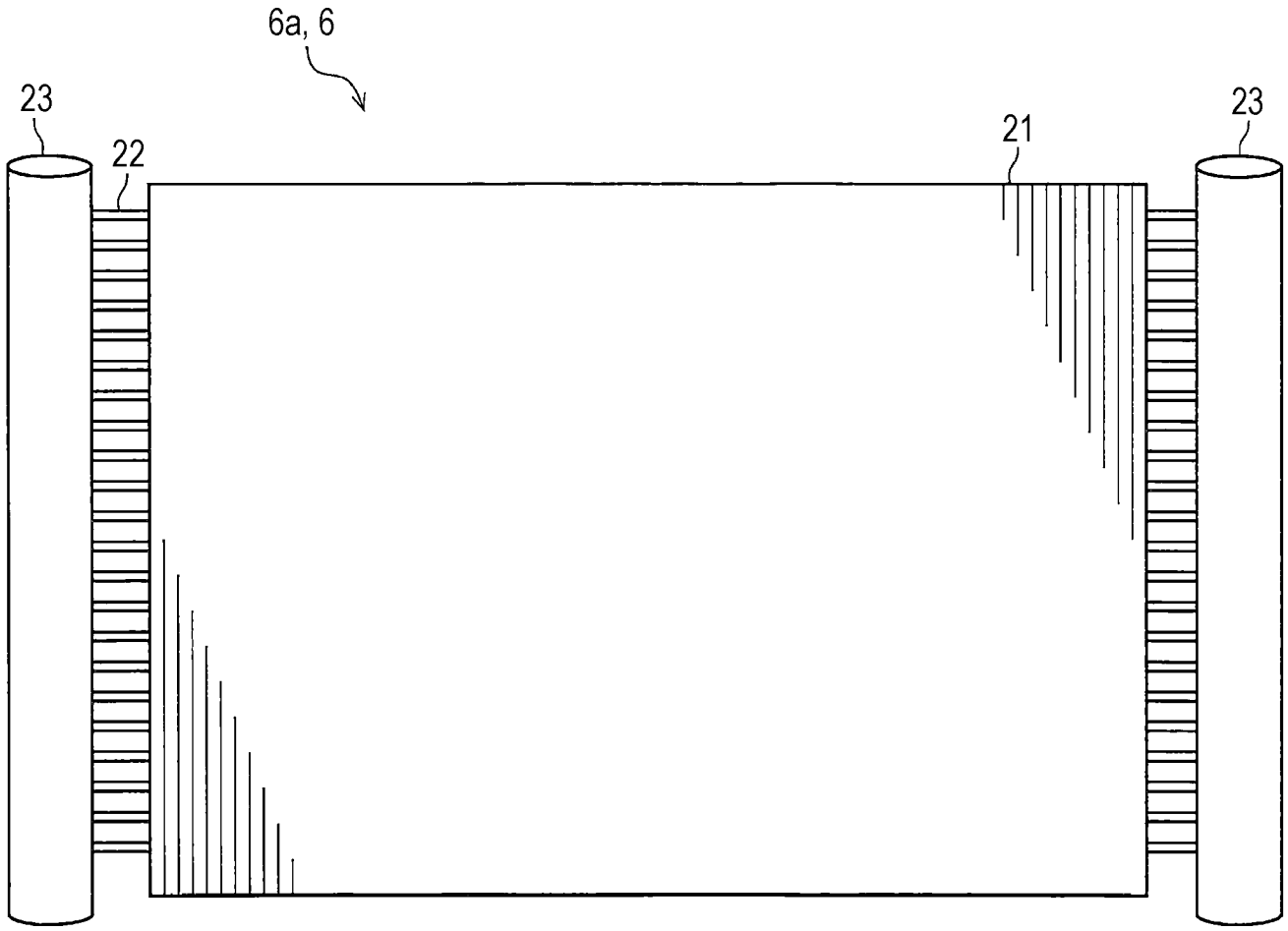
FIG. 3 is a view of an outer appearance of an outdoor heat exchanger of the air-conditioner according to the first embodiment.

FIG. 3 is a view of an outer appearance of the outdoor heat exchanger 6*a* of the air-conditioner 100 according to the first embodiment. Note that the outdoor heat exchanger 6*a* and the outdoor heat exchanger 6*b* forming the outdoor heat exchanger 6 have the same basic configuration (details will be described later with reference to FIG. 9), and therefore, the outdoor heat exchanger 6*a* will be hereinafter mainly described by way of example in description of the outdoor heat exchangers 6*a*, 6*b*.

In the outdoor heat exchanger 6*a*, heat transfer pipes 22 having a flat sectional shape (also see FIG. 7) are inserted into fins 21, and therefore, thermal connection among the fins 21 and the heat transfer pipes 22 is made. Thus, heat is exchanged between refrigerant flowing in the heat transfer pipes 22 and air sucked into the outdoor unit 1 (see FIG. 1). Then, each heat transfer pipe 22 is inserted into header pipes 23 as refrigerant pipe assemblies. Thus, refrigerant is injected into the heat transfer pipes 22 through the header pipe 23 (a header pipe 23*a* in FIG. 4) as a refrigerant inlet side, and through these heat transfer pipes, reaches the header pipe 23 (a header pipe 23*b* in FIG. 4) as a refrigerant outlet side.

Using the heat transfer pipes 22 having the flat sectional shape, the projection area of the heat transfer pipe as viewed from an air blowing direction of the outdoor air blower 7 is decreased. Thus, ventilation resistance in operation is reduced, and input power necessary for the outdoor air blower 7 is decreased. Consequently, performance of the air-conditioner is improved.

In the outdoor heat exchanger 6*a* described herein, the header pipes 23 and the heat transfer pipes 22 are connected to each other as described above. Thus, refrigerant flows in or out of the multiple heat transfer pipes 22 through the header pipes 23. In this state, the refrigerant is not equally distributed to each heat transfer pipe 22. Liquid refrigerant susceptible to influence of gravity tends to flow in the heat transfer pipes 22 positioned on a lower side in the direction of gravitational force, and gas refrigerant less susceptible to the influence of gravity tends to flow in the heat transfer pipes 22 positioned on an upper side in the direction of gravitational force. As a result, the mass flow rate of refrigerant is higher toward a lower portion of the outdoor heat exchanger 6*a*. Conversely, at an upper portion, the mass flow rate is lower. Thus, the upper portion of the outdoor heat exchanger 6*a* is in a state in which refrigerant is easily superheated. Then, when the upper portion of the outdoor heat exchanger 6*a* is brought into the easily-superheated state, refrigerant in the heat transfer pipes 22 positioned at the upper portion of the outdoor heat exchanger 6*a* is quickly vaporized, and almost no heat exchange is performed. As a result, performance of the outdoor heat exchanger 6*a* is lowered.

On this point, in a technique described in JP-A-2015-78830, a flow divider is used for reducing such refrigerant imbalance, and the inside of a header pipe is divided into multiple spaces by insertion of a partition plate to prevent the refrigerant imbalance. However, in this method, many distributors and many distribution pipes are used, and for this reason, a large space is necessary in an outdoor unit of an air-conditioner. Further, the number of components is increased, and for this reason, a cost might be increased.

For these reasons, in the present embodiment, a refrigerant flow path is formed such that refrigerant is divided into multiple flow paths parallel to each other inside the outdoor heat exchanger 6*a* and flows back and forth multiple times inside the flow paths and a forward route and a backward route are adjacent to each other. With this configuration, imbalance in the amount of refrigerant flowing from the header pipes 23 to the heat transfer pipes 22 is reduced with a small number of components.

Figure 4:
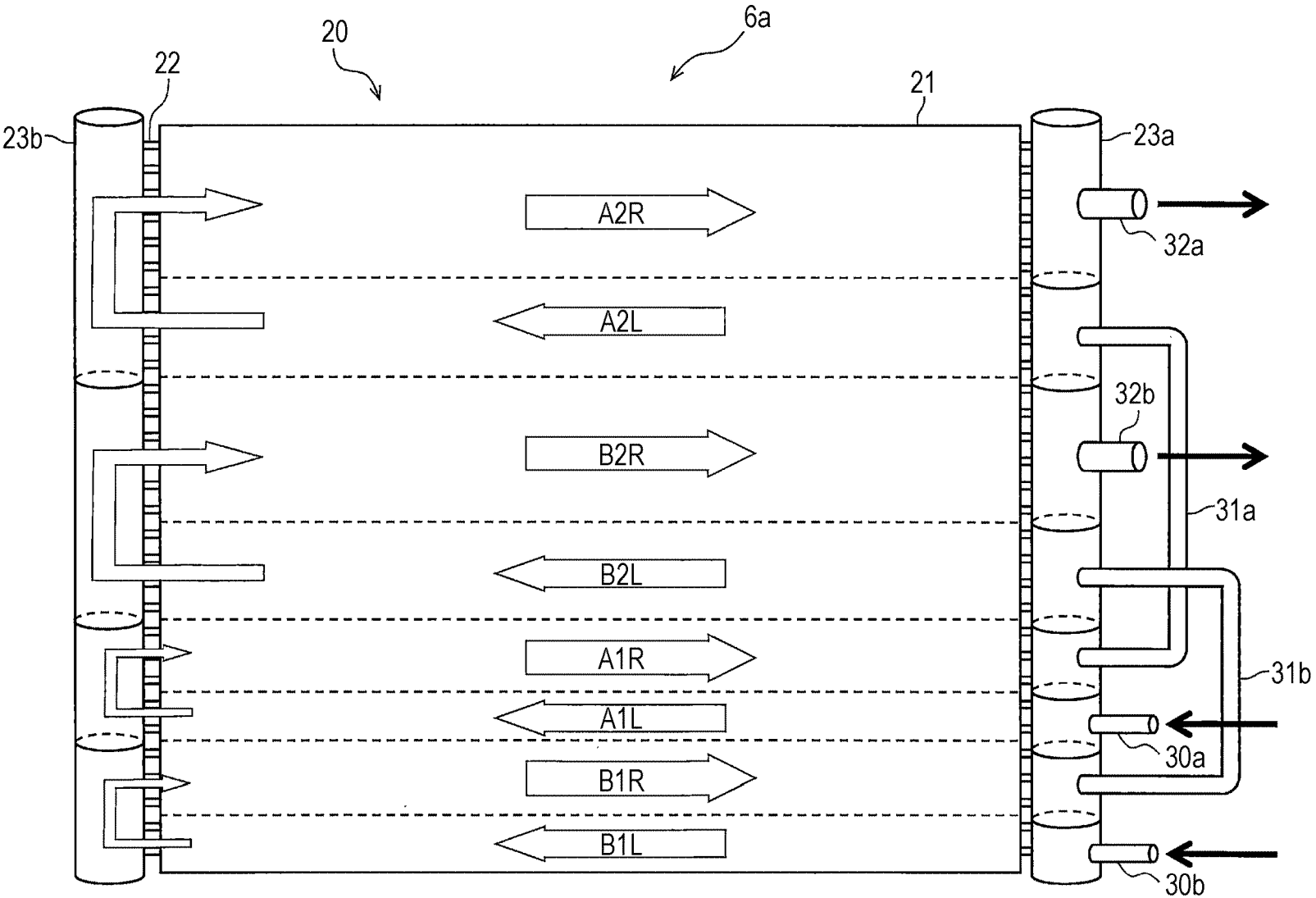
FIG. 4 is a view of a refrigerant flow path of the outdoor heat exchanger when the outdoor heat exchanger operates as an evaporator in the first embodiment.

FIG. 4 is a view of the refrigerant flow path of the outdoor heat exchanger 6*a* when the outdoor heat exchanger 6*a* operates as an evaporator. The refrigerant flow path is divided into two flow paths of a flow path (flow paths A1L, A1R, A2L, A2R) with a reference character "A" and a flow path (flow paths B1L, B1R, B2L, B2R) with a reference character "B." Hereinafter, the flow path with the reference character "A" will be referred to as a "flow path A," and the flow path with the reference character "B" will be referred to as a "flow path B."

In each of these flow paths A, B, two rounds are made between the header pipes 23*a* and 23*b* in a pair. In a first round of the flow path A, a flow path as the forward route is the flow path A1L, and a flow path as the backward route is the flow path MR. In a first round of the flow path B, a flow path as the forward route is the flow path B1L, and a flow path as the backward route is the flow path B1R. In a second round of the flow path A, a flow path as the forward route is the flow path A2L, and a flow path as the backward route is the flow path A2R. In a second round of the flow path B, a flow path as the forward route is the flow path B2L, and a flow path as the backward route is the flow path B2R.

Each of these flow paths is formed in such a manner that the heat transfer pipes 22 are connected in parallel. For example, in the lowermost flow path B1L in which a relatively-greater amount of liquid refrigerant having a smaller density that that of gas refrigerant tends to be present, two heat transfer pipes 22 are connected in parallel. Moreover, in the uppermost flow path A2R in which a relatively-greater amount of gas refrigerant having a smaller density than that of liquid refrigerant tends to be present, six heat transfer pipes 22 are connected in parallel, for example. Thus, refrigerant flows back and forth through the heat transfer pipes 22 connected in parallel between the header pipe 23*a* and the header pipe 23*b*.

Note that at the header pipe 23*a*, two pipes 30*a*, 30*b* are provided as liquid refrigerant inlets. Moreover, two pipes 32*a*, 32*b* are provided as gas refrigerant outlets. Refrigerant having reached the header pipe 23*a* through the flow path A1R flows upward through a pipe 31*a*, and flows toward the header pipe 23*b* through the flow path A2L again. Further, refrigerant having reached the header pipe 23*a* through the flow path B1R flows upward through a pipe 31*b*, and flows toward the header pipe 23*b* through the flow path B2L again.

When refrigerant flows back and forth in the same flow path A, B in the outdoor heat exchanger 6*a*, a path is formed such that the forward route and the backward route are adjacent to each other. For example, in a case where liquid refrigerant flows in the flow path B, the refrigerant flows into the flow path B1L through a liquid pipe 60*b*, and then, flows into the flow path B1R. In this case, the flow path B1L and the flow path B1R are adjacent to each other, and no other flow paths are sandwiched between the flow path B1L and the flow path B1R. The same applies to the flow paths A1L, A1R, the flow paths B2L, B2R, and the flow paths A2L, A2R. With this configuration, the number of heat transfer pipes 22 arranged in parallel in the same flow path is reduced without pipe connection to the header pipe 23*b*, and therefore, refrigerant distribution imbalance is improved.

Figure 5:
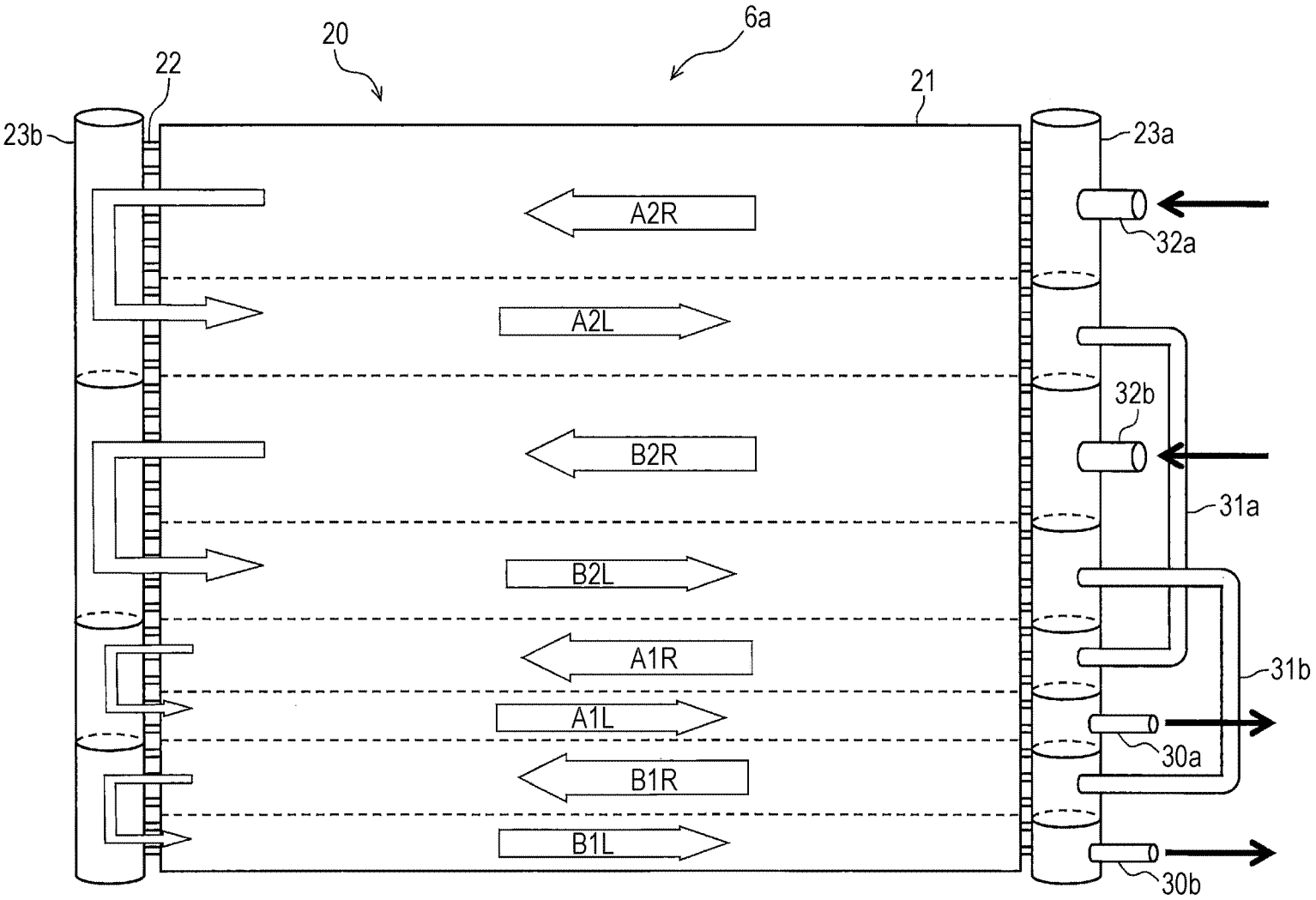
FIG. 5 is a view of a refrigerant flow path of the outdoor heat exchanger when the outdoor heat exchanger operates as a condenser in the first embodiment.

FIG. 5 is a view of the refrigerant flow path of the outdoor heat exchanger 6*a* when the outdoor heat exchanger 6*a* operates as a condenser. FIG. 5 illustrates a refrigerant flow when the outdoor heat exchanger 6*a* illustrated in FIG. 4 does not perform evaporation operation, but performs condensation operation. In FIG. 5, all refrigerant flow directions of FIG. 4 are reversed. As illustrated in FIG. 5, when refrigerant flows back from the forward route to the backward route or from the backward route to the forward route in the header pipe 23*a*, 23*b* in the condensation operation, the flow path is, in either case, formed such that the refrigerant flows back after having flowed downward in the direction of gravitational force. With this configuration, when the outdoor heat exchanger 6*a* operates as the condenser, i.e., refrigerant gradually changes into liquid refrigerant, the refrigerant flow is in a downward direction in the direction of gravitational force, and liquid refrigerant imbalance and accumulation are prevented.

When refrigerant returns from the outlet-side header pipe 23*b* to the inlet-side header pipe 23*a*, the refrigerant returns to the header pipe 23*a* through the heat transfer pipe 22 adjacent to the heat transfer pipe 22 through which the refrigerant has flowed when flowing from the header pipe 23*a* to the header pipe 23*b*. With this configuration, portions of external pipes brazed to the outlet-side header pipe 23*b* are reduced, and durability of the outdoor heat exchanger 6*a* is enhanced.

Second Embodiment

In the first embodiment described above, there is a probability that heat exchange performance of the outdoor heat exchanger 6*a* is lowered due to thermal conduction among the heat transfer pipes 22. For example, in many cases, refrigerant flowing in the heat transfer pipes 22, i.e., the flow paths A1L, B1L, in the vicinity of the pipes 30*a*, 30*b* (liquid refrigerant pipes) of the outdoor heat exchanger 6*a* in the condensation operation of FIG. 5 is in a supercooled state. Thus, the temperature of refrigerant in the adjacent flow paths A1R, B1R is higher than the temperature of refrigerant flowing in the flow paths A1L, B1L. For this reason, the refrigerant in the flow paths A1L, B1L is supposed to release heat, but conversely, might absorb heat due to influence of the refrigerant in the flow paths A1R, B1R. In this case, heat transfer performance of the outdoor heat exchanger 6*a* is lowered, leading to lower performance of the air-conditioner 100.

For these reasons, in a second embodiment, when refrigerant flows back in a header pipe 23*a*, 23*b* in a partial refrigerant flow path in condensation operation, a flow path is formed such that the refrigerant flows back after having flowed upward in the direction of gravitational force. With this configuration, when refrigerant returns to the header pipe 23*b* at the end in flow paths A, B, the flow path A and the flow path B (specifically, a flow path A1L and a flow path B1L) are adjacent to each other. With this configuration, the flow paths A, B having relatively-close refrigerant temperatures are adjacent to each other to prevent excessive heat exchange and prevent lowering of heat exchange performance in an outdoor heat exchanger 6*a*.

Figure 6:
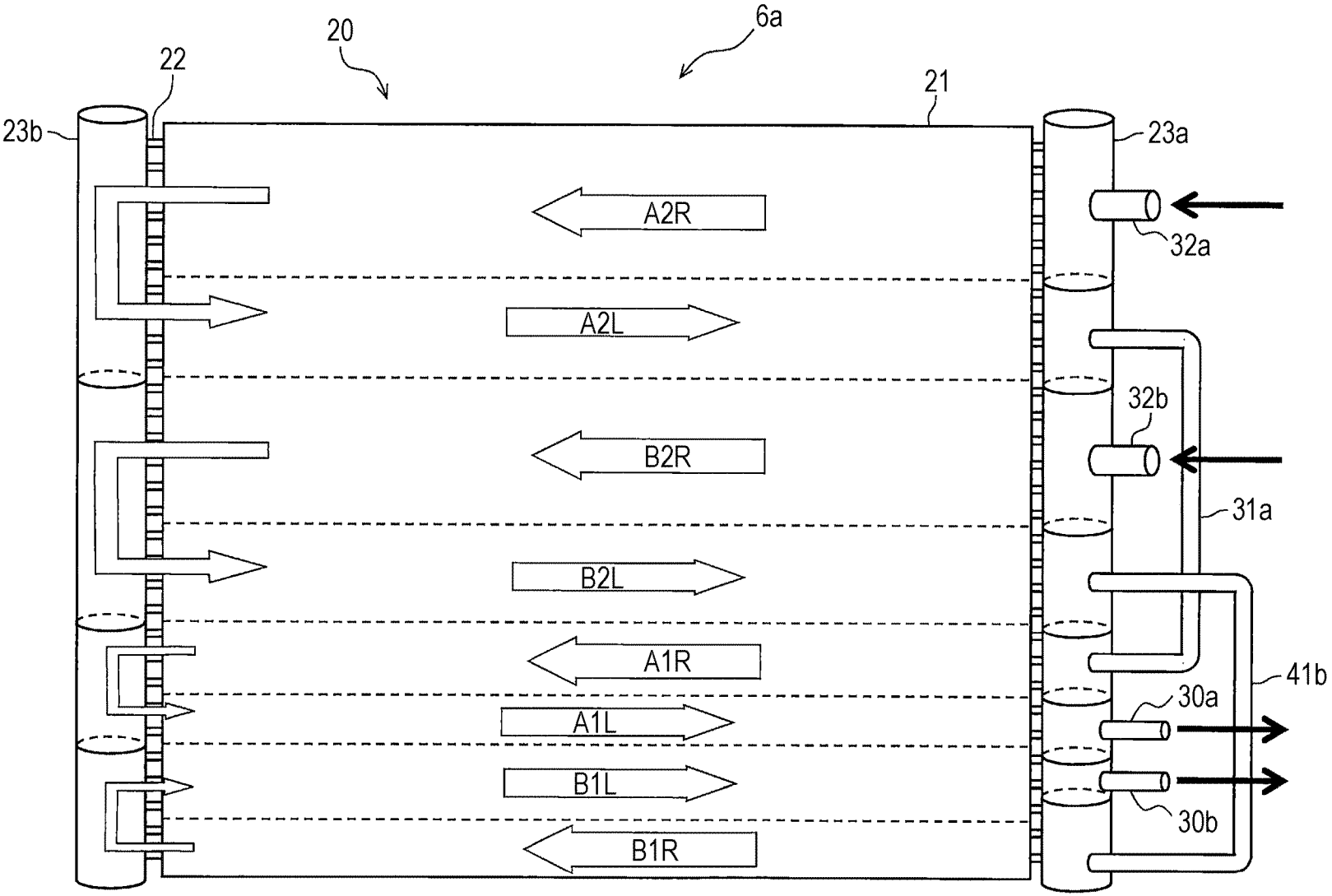
FIG. 6 is a view of a refrigerant flow path of an outdoor heat exchanger when the outdoor heat exchanger operates as a condenser in a second embodiment.

FIG. 6 is a view of a refrigerant flow path of the outdoor heat exchanger 6*a* when the outdoor heat exchanger 6*a* operates as a condenser in the second embodiment. Note that in the second embodiment, other configurations than that of the outdoor heat exchanger 6*a* are the same as those of the first embodiment described above, and therefore, the configuration of the outdoor heat exchanger 6*a* will be mainly described below. FIG. 6 illustrates an example where a partial refrigerant flow path in the condensation operation of FIG. 5 as described above is formed as such a flow path that refrigerant flows back after having flowed upward in the direction of gravitational force.

As compared to the above-described refrigerant flow path illustrated in FIG. 5, the positions of the flow paths B1L and B1R are inverted in an upper-to-lower direction. Refrigerant in both flow paths A1L and B1L is in a backward route of a second round, and is assumed to have the substantially same temperature. Thus, lowering of the heat exchange performance due to thermal conduction between the flow path A1L and the flow path B1L is less likely to occur. Consequently, lowering of the heat exchange performance in the outdoor heat exchanger 6*a* is sufficiently prevented.

Third Embodiment

The second embodiment described above is an embodiment in which lowering of the heat exchange performance in the outdoor heat exchanger 6*a* is sufficiently prevented. However, still in some cases, there is a temperature difference between refrigerant in the flow path A1L and refrigerant in the flow path B1L due to, e.g., a slight difference in an air contact portion of the outdoor heat exchanger 6*a*. In this case, the heat exchange performance might be lowered. For this reason, a third embodiment is an embodiment in which improvement is made considering such a point.

In FIG. 6 described above, spots with the probability of lowering heat exchange performance due to thermal conduction between heat transfer pipes include the total of six spots between a flow path A2R and a flow path A2L, between the flow path A2L and a flow path B2R, between the flow path B2R and a flow path B2L, between the flow path B2L and a flow path A1R, between the flow path A1R and a flow path A1L, and between a flow path B1L and a flow path B1R. Of these spots, flow paths, i.e., the flow paths A1L, B1L, in the vicinity of pipes 30*a*, 30*b* in a supercooled state are susceptible to influence of heat transfer from the adjacent flow paths A1R, B1R.

Thus, in the third embodiment, fins at the spots with the probability of lowering the performance due to thermal conduction are processed. For example, a slit is formed at a fin 21, or the fin 21 is cut along a substantially horizontal plane. With this configuration, lowering of the heat exchange performance due to thermal conduction among the heat transfer pipes 22 is prevented.

Figure 7:
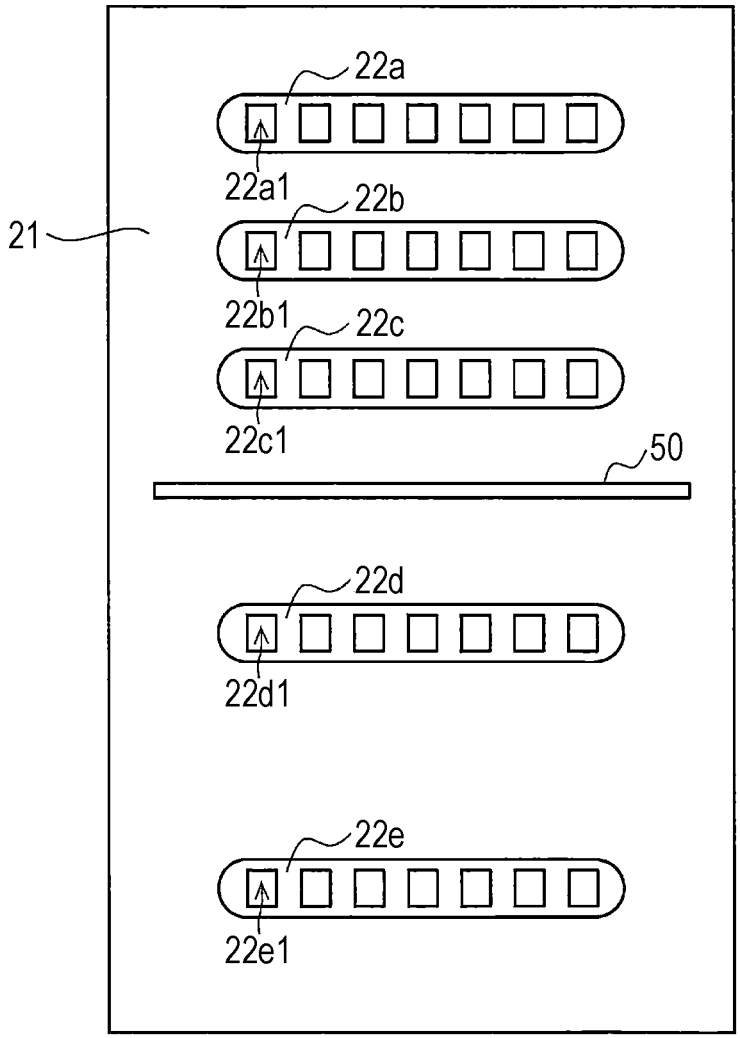
FIG. 7 is a view of the shape of a fin in an outdoor heat exchanger in a third embodiment.

FIG. 7 is a view of the shape of the fin 21 of the outdoor heat exchanger 6*a* in the third embodiment. Heat transfer pipes 22*a*, 22*b*, 22*c*, 22*d*, 22*e* illustrated in FIG. 7 are some of the heat transfer pipes 22 described above. Spaces 22*a*1, 22*b*1, 22*c*1, 22*d*1, 22*e*1 as refrigerant flow spaces are each formed inside the heat transfer pipes 22*a*, 22*b*, 22*c*, 22*d*, 22*e*. Of these heat transfer pipes 22*a*, 22*b*, 22*c*, 22*d*, 22*e*, the heat transfer pipes 22*a*, 22*b*, 22*c* belong to the flow path A1R (see FIG. 6). Moreover, the heat transfer pipes 22*d*, 22*e* belong to the flow path A1L (see FIG. 6).

In condensation operation of the outdoor heat exchanger 6*a*, refrigerant flowing in the heat transfer pipes 22*a*, 22*b*, 22*c* has a higher temperature than that of refrigerant flowing in the heat transfer pipes 22*d*, 22*e*, and there is a temperature difference (note that the refrigerant flowing in the heat transfer pipes 22*d*, 22*e* is often in a supercooled state at this point). Thus, there is a probability that the refrigerant flowing in the heat transfer pipes 22*a*, 22*b*, 22*c* releases heat to the heat transfer pipes 22*d*, 22*e*, and therefore, the heat exchange performance is lowered. For this reason, in the third embodiment, a slit 50 is formed between the heat transfer pipe 22*c* and the heat transfer pipe 22*d*, i.e., between the flow path A1R and the flow path A1L. With this configuration, unintended heat exchange between the flow paths A1R and A1L is prevented, and lowering of the heat exchange performance due to thermal conduction is prevented.

Note that although not shown in the figure, a slit is also formed between the flow path B1R and the flow path B1L in the third embodiment.

Fourth Embodiment

In the third embodiment described above, the slit 50 is formed at the fin 21. However, for preventing lowering of heat exchange performance due to thermal conduction, it is effective not only to form the slit 50, but also to employ the following configuration.

Figure 8:
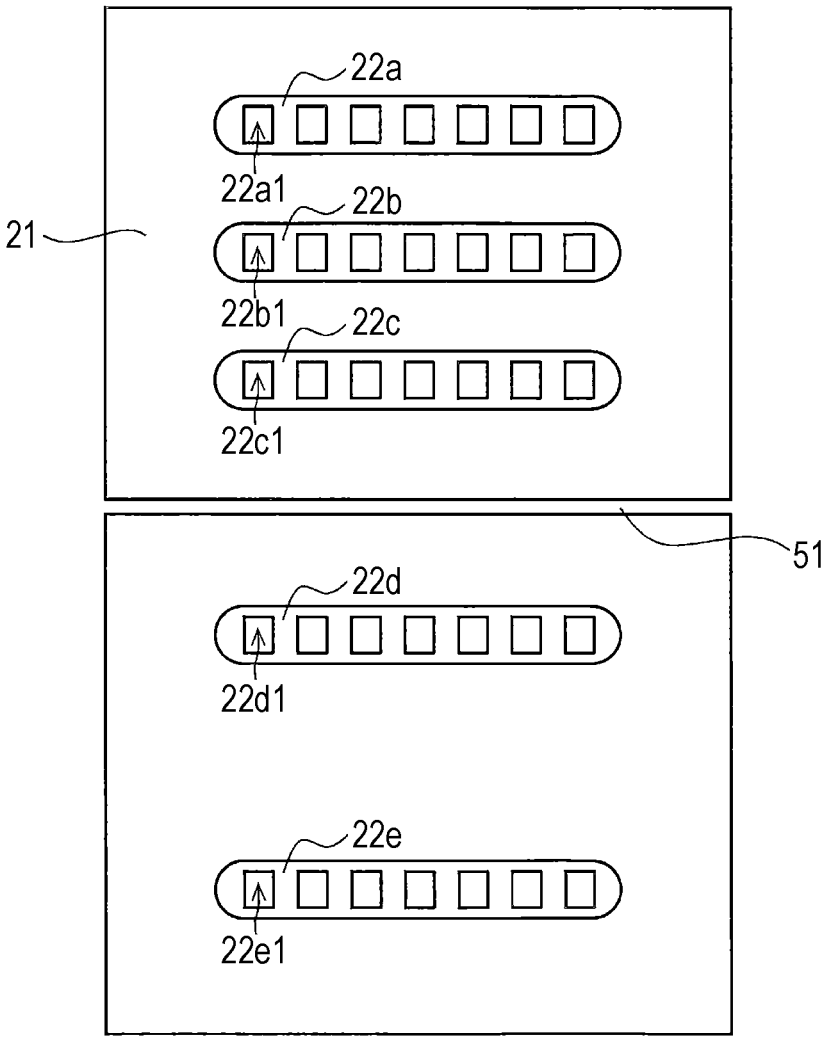
FIG. 8 is a view of the shape of a fin in an outdoor heat exchanger in a fourth embodiment.

FIG. 8 is a view of the shape of a fin 21 in an outdoor heat exchanger 6*a* in a fourth embodiment. In the fourth embodiment illustrated in FIG. 8, a cut portion 51 is formed instead of the slit 50 in the third embodiment described above. That is, in the fourth embodiment, the fin 21 thermally connected to heat transfer pipes 22*a*, 22*b*, 22*c* and the fin 21 thermally connected to heat transfer pipes 22*d*, 22*e* are not integrally provided, but are independently provided. With this configuration, unintended heat exchange between flow paths A1R and A1L is also prevented, and lowering of the heat exchange performance due to thermal conduction is also prevented.

Note that although not shown in the figure, the fin thermally connected to a flow path B1R and the fin 21 thermally connected to a flow path B1L are also independently provided in the fourth embodiment.

Fifth Embodiment

Figure 9:
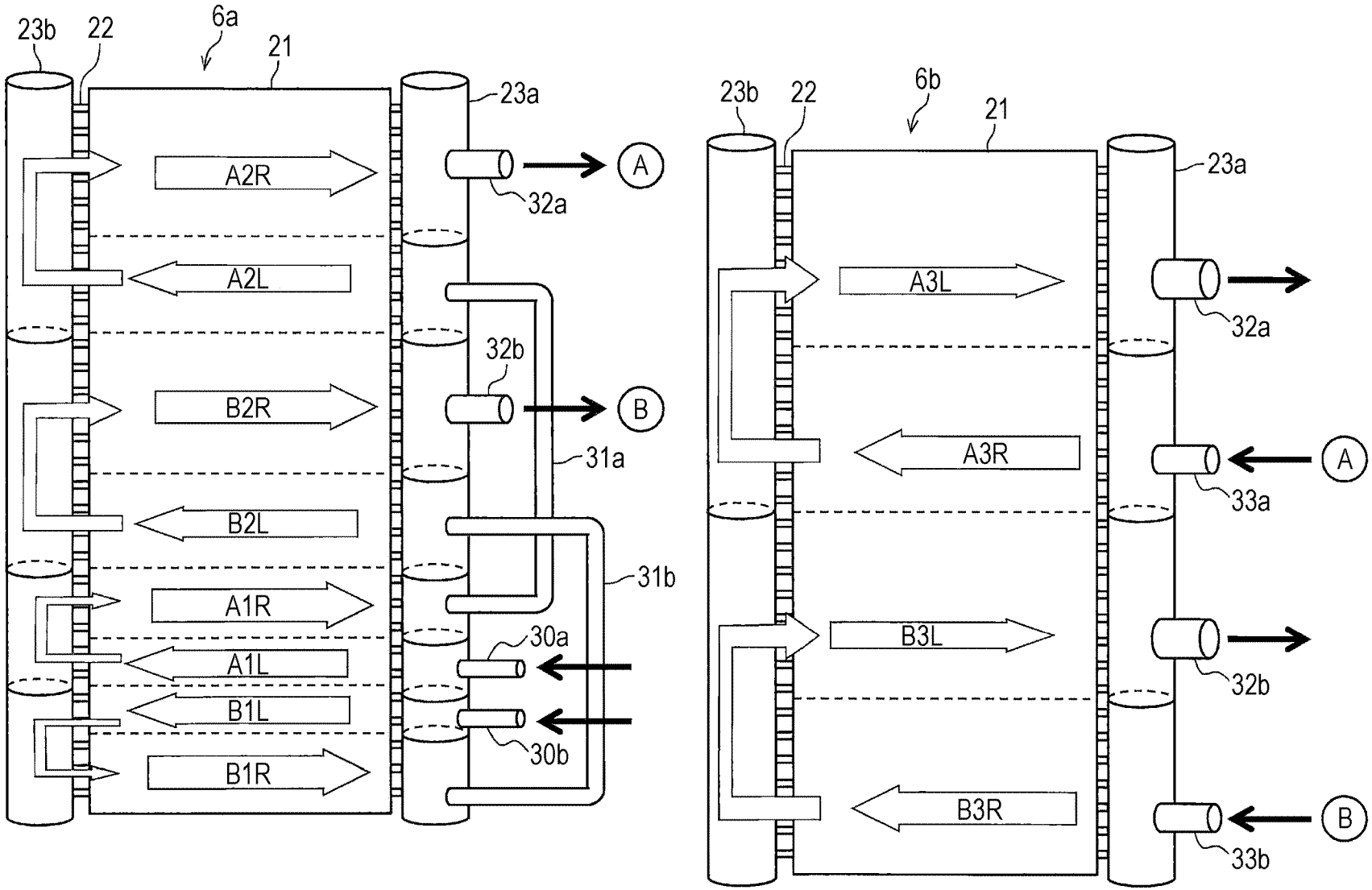
FIG. 9 is a view of a refrigerant flow path in the entirety of an outdoor heat exchanger in a fifth embodiment.

FIG. 9 is a view of a refrigerant flow path across the entirety of an outdoor heat exchanger 6 in a fifth embodiment. As described above with reference to FIG. 2, the outdoor heat exchanger 6 includes an outdoor heat exchanger 6*a* arranged on a windward side along an air flow direction and an outdoor heat exchanger 6*b* arranged on a leeward side along the air flow direction. Thus, in FIG. 9, both of the outdoor heat exchangers 6*a*, 6*b* are illustrated. Of these components, the outdoor heat exchanger 6*a* is arranged on the windward side in the flow direction of air generated in association with driving of an outdoor air blower 7, and the outdoor heat exchanger 6*b* is arranged on the leeward side.

The outdoor heat exchanger 6*a* arranged on the windward side and the outdoor heat exchanger 6*b* arranged on the leeward side are connected to each other through pipes 32*a*, 32*b* and pipes 33*a*, 33*b*. Thus, refrigerant flowing out of the outdoor heat exchanger 6*a* through the pipe 32*a* of the outdoor heat exchanger 6*a* is injected into the outdoor heat exchanger 6*b* through the pipe 33*a* of the outdoor heat exchanger 6*b*. Moreover, refrigerant flowing out of the outdoor heat exchanger 6*a* through the pipe 32*b* of the outdoor heat exchanger 6*a* is injected into the outdoor heat exchanger 6*b* through the pipe 33*b* of the outdoor heat exchanger 6*b*.

In the outdoor heat exchanger 6*a* arranged on the windward side, refrigerant flows with two rounds between header pipes 23*a* and 23*b*. On the other hand, in the outdoor heat exchanger 6*b* arranged on the leeward side, refrigerant flows with a single round between the header pipes 23*a* and 23*b*. That is, the number of rounds of refrigerant between the inlet-side header pipe 23*a* and the outlet-side header pipe 23*b* in the outdoor heat exchanger 6*a* arranged on the windward side is greater than the number of rounds of refrigerant between the header pipe 23*a* and the header pipe 23*b* in the outdoor heat exchanger 6*b* arranged on the leeward side.

Liquid refrigerant having flowed into the header pipe 23*a* form the pipe (a liquid refrigerant pipe) 30*a* flows, across the entirety of the outdoor heat exchanger 6, in the order of a flow path A1L, a flow path A1R, a pipe 31*a*, a flow path A2L, a flow path A2R, the pipe 32*a*, the pipe 33*a*, a flow path A3R, a flow path A3L, and the pipe (a gas refrigerant pipe) 32*a*. Moreover, liquid refrigerant having flowed in through a pipe (a liquid refrigerant pipe) 30*b* flows, across the entirety of the outdoor heat exchanger 6, in the order of a flow path B1L, a flow path B1R, a pipe 31*b*, a flow path B2L, a flow path B2R, the pipe 32*b*, the pipe 33*b*, a flow path B3R, a flow path B3L, and the pipe (a gas refrigerant pipe) 32*b*.

As described above, the number of rounds of refrigerant in the outdoor heat exchanger 6*a* arranged on the windward side is greater than the number of rounds of refrigerant in the outdoor heat exchanger 6*b* arranged on the leeward side. With this refrigerant flow path, the number of heat transfer pipes 22 arranged in parallel in the flow paths in the vicinity of the pipes 32*a*, 32*b* is increased, and therefore, a pressure loss is reduced and heat exchange performance is improved. Moreover, the number of heat transfer pipes 22 arranged in parallel in the flow paths in the vicinity of the pipes 30*a*, 30*b* is decreased, and therefore, thermal conductivity is increased due to an increase in a flow rate and the heat exchange performance is improved.

In refrigerant heat exchange, influence of the pressure loss on the heat exchange performance is great in a case where almost all of refrigerant is in the gaseous state, and influence of the refrigerant flow rate on the performance of the heat exchanger is great in a case where almost all of refrigerant is in the liquid state. Thus, the number of rounds of refrigerant on the leeward side is set smaller than the number of rounds of refrigerant on the windward side as illustrated in FIG. 9, and therefore, the heat exchange performance in both of the outdoor heat exchangers 6*a*, 6*b* is improved.

What is claimed is:

1. An outdoor heat exchanger for an air-conditioner, comprising:

a fin;

multiple heat transfer pipes thermally connected to the fin, having a flat sectional shape, and configured such that refrigerant flows in the multiple heat transfer pipes;

an inlet-side header pipe and an outlet-side header pipe each connected to respective inlet sides and outlet sides of the multiple heat transfer pipes, the inlet-side header pipe including multiple refrigerant inlet pipes and multiple refrigerant outlet pipes; and at least two refrigerant flow path systems, including a first refrigerant flow path system and a second refrigerant flow path system, each of the first refrigerant flow path system and the second refrigerant flow path system including a first pair of flow paths and a second pair of flow paths, each of the first pair of flow paths and the second pair of flow paths include at least two of the multiple heat transfer pipes, wherein the refrigerant flows through the multiple heat transfer pipes between the inlet-side header pipe and the outlet-side header pipe so that heat exchange in the outdoor heat exchanger is performed, wherein each of the first pair of flow paths and the second pair of flow paths includes a first inlet flow path in communication with one of the multiple refrigerant inlet pipes via the inlet-side header and a second flow path, which is a return flow path that is adjacent to the first inlet flow path and returns refrigerant that flowed through the first inlet flow path, wherein the second pair of flow paths includes a third flow path through which refrigerant flows from the second flow path and a fourth flow path, which is a return flow path that is adjacent to the third flow path and returns refrigerant that flowed through the third flow path and is in communication with one of the multiple refrigerant outlet pipes via the inlet-side header, wherein the first pair of flow paths of the first refrigerant flow path system is adjacent to the first pair of flow paths of the second refrigerant flow path system, and wherein the first pair of flow paths of the second refrigerant flow path system is adjacent to the second pair of flow paths of the first refrigerant flow path system.

2. The outdoor heat exchanger according to claim 1, wherein each of the inlet-side header pipe, the outlet-side header pipe, and the multiple heat transfer pipes are configured such that:

when the air-conditioner operates with the outdoor heat exchanger functioning as an evaporator, the refrigerant having returned from the outlet-side header pipe flows upward in the inlet-side header pipe and the refrigerant flowing toward the outlet-side header pipe flows upward in the outlet-side header pipe, and when the air-conditioner operates with the outdoor heat exchanger functioning as a condenser, the refrigerant having returned from the outlet-side header pipe flows downward in the inlet-side header pipe and the refrigerant flowing toward the outlet-side header pipe flows downward in the outlet-side header pipe.

3. The outdoor heat exchanger according to claim 1, wherein a slit or a cut portion is, at the fin, disposed between adjacent ones of the heat transfer pipes.

4. The outdoor heat exchanger according to claim 2, wherein a slit or a cut portion is, at the fin, disposed between adjacent ones of the heat transfer pipes.

5. An air-conditioner, comprising:

an outdoor fan generating air flow in an air flow direction;

a first outdoor heat exchanger disposed on a windward side in the air flow direction and a second outdoor heat exchanger disposed on a leeward side in the air flow direction, and wherein each of the first outdoor heat exchanger and the second indoor heat exchanger includes:

a fin;

multiple heat transfer pipes thermally connected to the fin, having a flat sectional shape, and configured such that refrigerant flows in the multiple heat transfer pipes; and an inlet-side header pipe and an outlet-side header pipe each connected to respective inlet sides and outlet sides of the multiple heat transfer pipes, the inlet-side header pipe including multiple refrigerant inlet pipes and multiple refrigerant outlet pipes;

wherein the first heat exchanger includes:

at least two refrigerant flow path systems, including a first refrigerant flow path system and a second refrigerant flow path system, each of the first refrigerant flow path system and the second refrigerant flow path system including a first number of flow paths including at least a first pair of flow paths and a second pair of flow paths, each of the first pair of flow paths and the second pair of flow paths include at least two of the multiple heat transfer pipes, wherein the refrigerant flows through the multiple heat transfer pipes between the inlet-side header pipe and the outlet-side header pipe so that heat exchange in the first outdoor heat exchanger is performed, wherein each of the first pair of flow paths and the second pair of flow paths includes a first inlet flow path in communication with one of the multiple refrigerant inlet pipes via the inlet-side header and a second flow path, which is a return flow path that is adjacent to the first inlet flow path and returns refrigerant that flowed through the first inlet flow path, wherein the second pair of flow paths includes a third flow path through which refrigerant flows from the second flow path and a fourth flow path, which is a return flow path that is adjacent to the third flow path and returns refrigerant that flowed through the third flow path and is in communication with one of the multiple refrigerant outlet pipes via the inlet-side header, wherein the first pair of flow paths of the first refrigerant flow path system is adjacent to the first pair of flow paths of the second refrigerant flow path system, wherein the first pair of flow paths of the second refrigerant flow path system is adjacent to the second pair of flow paths of the first refrigerant flow path system wherein the second outdoor heat exchanger includes:

at least two refrigerant flow path systems, including a first refrigerant flow path system and a second refrigerant flow path system, each of the first refrigerant flow path system and the second refrigerant flow path system including a second number of pairs of flow paths that is less than the first number of flow paths that includes a first pair of flow paths that includes at least two of the multiple heat transfer pipes, wherein the refrigerant flows through the multiple heat transfer pipes between the inlet-side header pipe and the outlet-side header pipe so that heat exchange in the outdoor heat exchanger is performed, wherein the first pair of flow paths includes a first inlet flow path in communication with one of the multiple refrigerant inlet pipes via the inlet-side header and a second flow path, which is a return flow path that is adjacent to the first inlet flow path and returns refrigerant that flowed through the first inlet flow path and is in communication with one of the multiple refrigerant outlet pipes via the inlet-side header, and wherein the first pair of flow paths of the first refrigerant flow path system is adjacent to the first pair of flow paths of the second refrigerant flow path system.

6. An air-conditioner comprising:

an outdoor heat exchanger comprising:

a fin;

multiple heat transfer pipes thermally connected to the fin, having a flat sectional shape, and configured such that refrigerant flows in the multiple heat transfer pipes;

an inlet-side header pipe and an outlet-side header pipe each connected to respective inlet sides and outlet sides of the multiple heat transfer pipes, the inlet-side header pipe including multiple refrigerant inlet pipes and multiple refrigerant outlet pipes; and at least two refrigerant flow path systems, including a first refrigerant flow path system and a second refrigerant flow path system, each of the first refrigerant flow path system and the second refrigerant flow path system including a first pair of flow paths and a second pair of flow paths, each of the first pair of flow paths and the second pair of flow paths include at least two of the multiple heat transfer pipes, wherein the refrigerant flows through the multiple heat transfer pipes between the inlet-side header pipe and the outlet-side header pipe so that heat exchange in the outdoor heat exchanger is performed, wherein each of the first pair of flow paths and the second pair of flow paths includes a first inlet flow path in communication with one of the multiple refrigerant inlet pipes via the inlet-side header and a second flow path, which is a return flow path that is adjacent to the first inlet flow path and returns refrigerant that flowed through the first inlet flow path, wherein the second pair of flow paths includes a third flow path through which refrigerant flows from the second flow path and a fourth flow path, which is a return flow path that is adjacent to the third flow path and returns refrigerant that flowed through the third flow path and is in communication with one of the multiple refrigerant outlet pipes via the inlet-side header, wherein the first pair of flow paths of the first refrigerant flow path system is adjacent to the first pair of flow paths of the second refrigerant flow path system, and wherein the first pair of flow paths of the second refrigerant flow path system is adjacent to the second pair of flow paths of the first refrigerant flow path system.

* * * * *